US009889650B2

(12) United States Patent
Kodoi et al.

(10) Patent No.: US 9,889,650 B2
(45) Date of Patent: Feb. 13, 2018

(54) LIQUID EJECTING HEAD, EJECTING ELEMENT SUBSTRATE AND LIQUID EJECTING APPARATUS

(71) Applicant: CANON KABUSHIKI KAISHA, Tokyo (JP)

(72) Inventors: Takuma Kodoi, Kawasaki (JP); Keiji Tomizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/155,590

(22) Filed: May 16, 2016

(65) Prior Publication Data

US 2016/0339700 A1 Nov. 24, 2016

(30) Foreign Application Priority Data

May 22, 2015 (JP) ..... 2015-104876

(51) Int. Cl.
*B41J 2/145* (2006.01)
*B41J 2/14* (2006.01)

(52) U.S. Cl.
CPC ..... *B41J 2/14112* (2013.01); *B41J 2/1404* (2013.01); *B41J 2/145* (2013.01)

(58) Field of Classification Search
CPC ..... B41J 2/14427; B41J 2/14; B41J 2/1404; B41J 2/14145; B41J 2/1412; B41J 2/1433; B41J 2/14129; B41J 2/14112; B41J 2/14016; B41J 2/145
USPC ..... 347/40, 44, 54, 56, 61, 63, 65
See application file for complete search history.

(56) References Cited

U.S. PATENT DOCUMENTS

| | | | |
|---|---|---|---|
| 6,830,317 | B2 | 12/2004 | Tsuchii et al. |
| 7,654,648 | B2 | 2/2010 | Tomizawa et al. |
| 7,735,962 | B2 | 6/2010 | Matsumoto et al. |
| 7,784,904 | B2 | 8/2010 | Ide et al. |
| 7,963,633 | B2 | 6/2011 | Oikawa et al. |
| 7,963,635 | B2 | 6/2011 | Oikawa et al. |
| 8,087,759 | B2 | 1/2012 | Oikawa et al. |
| 8,177,329 | B2 | 5/2012 | Matsumoto et al. |
| 8,210,655 | B2 | 7/2012 | Muraoka et al. |
| 8,500,251 | B2 | 8/2013 | Kubo |
| 8,544,977 | B2 | 10/2013 | Kodoi |

FOREIGN PATENT DOCUMENTS

JP 2005-193579 A 7/2005

*Primary Examiner* — Jannelle M Lebron
(74) *Attorney, Agent, or Firm* — Fitzpatrick, Cella, Harper & Scinto

(57) ABSTRACT

There are provided a liquid ejecting head, an ejecting element substrate and a liquid ejecting apparatus that can suppress degradation in print quality. Therefore in an ejecting element substrate arranged the closest to the center of a support member, a flow resistance of a flow passage corresponding to an ejection opening of an ejection opening array arranged the closest to the center of the ejecting element substrate is made high.

2 Claims, 12 Drawing Sheets

LIQUID EJECTING HEAD, EJECTING ELEMENT SUBSTRATE AND LIQUID EJECTING APPARATUS

BACKGROUND OF THE INVENTION

Field of the Invention

The present invention relates to a liquid ejecting head, an ejecting element substrate and a liquid ejecting apparatus for ejecting liquids such as ink toward various kinds of media.

Description of the Related Art

Recently because of a requirement for a high-speed print, ejection opening arrays arrayed in a liquid ejecting head are required to be lengthened and arrayed in a multiple array and an ejecting element substrate is required to be miniaturized, so that a high concentration of the ejection opening arrays is required and a problem due to the high concentration occurs.

Japanese Patent Laid-Open No. 2005-193579 discloses the solution to a problem that a heat distribution differs in a print element substrate and the ejection performance (ejection amount) changes due to a difference in the influence of heat received, thus degrading the print quality. According to the solution disclosed in Japanese Patent Laid-Open No. 2005-193579, ejecting inks of a light color to an ejection opening array arranged in a place within the ejecting element substrate susceptible to the thermal influence suppresses the degradation of the print quality visually.

However, there occurs a new problem that cannot be solved by the method disclosed by Japanese Patent Laid-Open No. 2005-193579. When a temperature of the ejecting element substrate during the ejecting partially increases, the viscosity of the liquid decreases, increasing a refill speed of the liquid. As a result, there are some cases where the liquid overflows from an ejection opening to stay on the surface of the ejection opening, so that an ejection defect such as non-ejection occurs to degrade the print quality.

SUMMARY OF THE INVENTION

Therefore, the present invention provides a liquid ejecting head, an ejecting element substrate and a liquid ejecting apparatus that can suppress degradation in print quality.

A liquid ejecting head according to the present invention comprises a plurality of ejection openings for ejecting liquids, flow passages communicated with the ejection openings, and energy generating elements for generating energy used for ejection of the liquids from the ejection openings, wherein the ejection opening closer to the center in an arrangement area where the ejection openings are arranged is communicated with the flow passage having the higher flow resistance.

With the present invention, there can be realized the liquid ejecting head, the ejecting element substrate and the liquid ejecting apparatus that can suppress the degradation in print quality.

Further features of the present invention will become apparent from the following description of exemplary embodiments (with reference to the attached drawings).

DESCRIPTION OF THE EMBODIMENTS

First Embodiment

Hereinafter, an explanation will be made of a first embodiment of the present invention with reference to the accompanying drawings.

Figure 1:
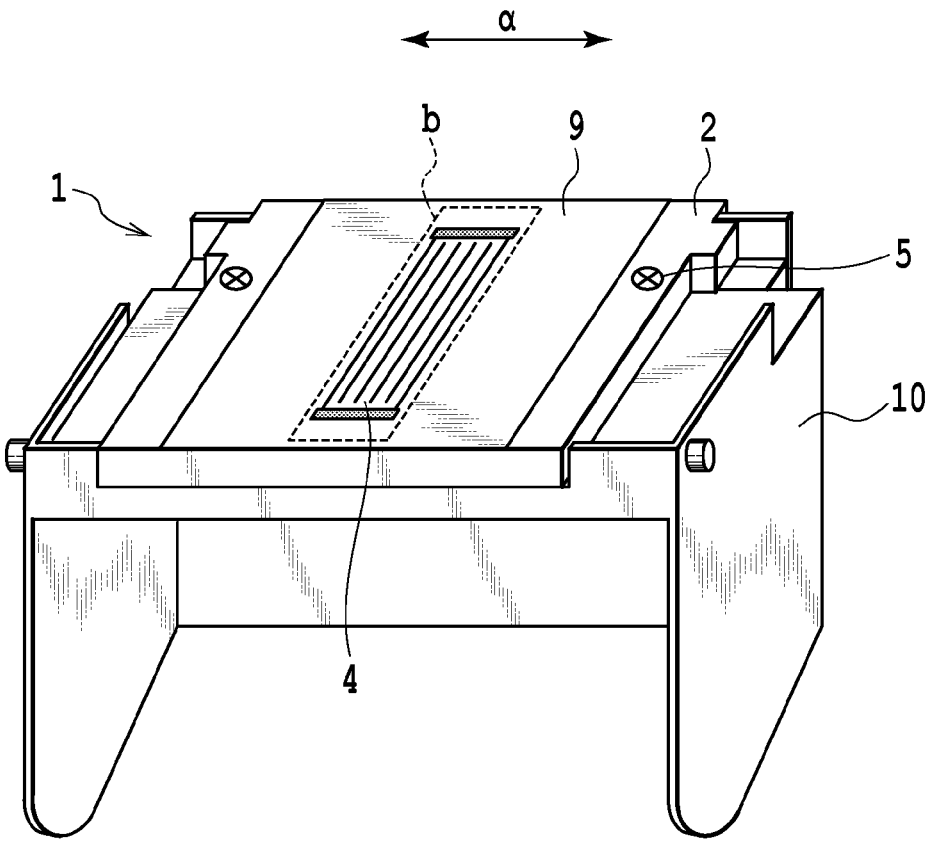
FIG. 1 is a perspective view illustrating a liquid ejecting head according to a first embodiment of the present invention.

FIG. 1 is a perspective view illustrating a liquid ejecting head 1 to which the present invention is applicable. A support member 9 on which an ejecting element substrate 4 is disposed is fixed on a housing 10 made of resin by pins 5. The support member 9 is made of metal in some case or is made of resin in the other case, and a material thereof is not limited to a particular one.

The support member 9 is provided with supply ports and a liquid chamber to which liquids (hereinafter, called ink as well) are supplied through the housing 10. The liquid chamber inside the support member 9 is connected to the supply port 7 disposed in each of ejection opening arrays in the ejecting element substrate 4. The ejection opening array disposed in the ejecting element substrate 4 is formed by aligned (in a predetermined direction) ejection openings 12 as holes communicated with foaming chambers 17 which are pressure rooms retaining inks to be ejected.

The liquid ejecting head 1 uses heat generated from a heating resistance element (energy generating element) with application of electrical energy as energy for ejecting the ink. The heat generation causes film boiling of the ink to eject the ink from the ejection openings 12 with the foaming energy. At printing, the liquid ejecting head 1 reciprocates in an arrow α direction in FIG. 1 (direction crossing the predetermined direction) and ejects the ink onto a print medium from the ejection openings, thus performing a print.

Figure 2A:
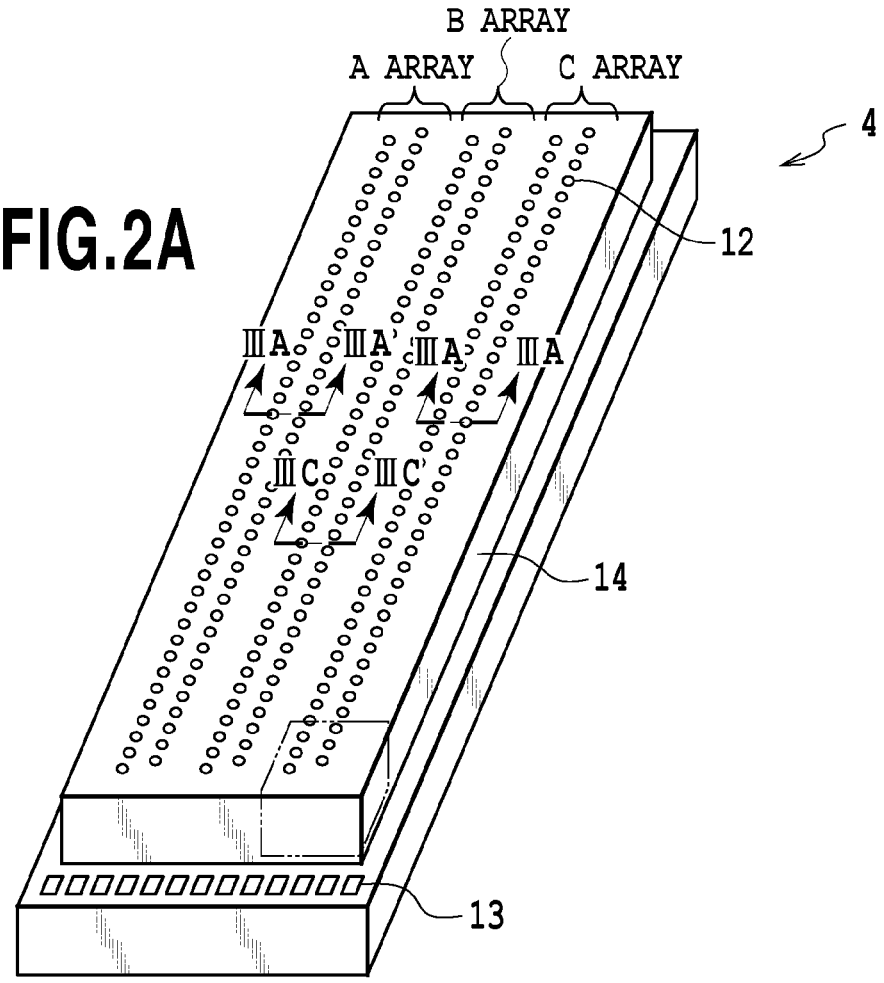
FIG. 2A is a perspective view illustrating an ejecting element substrate according to the first embodiment.
Figure 2B:
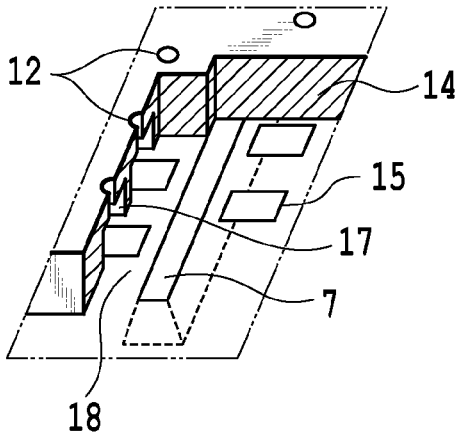
FIG. 2B is a diagram illustrating a part of the ejecting element substrate in an enlarged manner according to the first embodiment.

FIG. 2A is a perspective view illustrating the ejecting element substrate 4 in the present embodiment. FIG. 2B is a diagram illustrating a part of the ejecting element substrate 4 in an enlarged manner. Here, the ejection opening array in the liquid ejecting head 1 will be in detail explained. A length of the ejection opening array is one inch or more. The ejection openings 12 comprise 1500 or more with an array concentration of 1200 dpi for each ejection opening array, and an ejection amount per one ejection opening 12 is approximately 4 ng±1 ng. In addition, a common liquid chamber 18 is formed between the supply port 7 and the foaming chamber 17, which is a route for supplying ink to the individual foaming chambers 17. The common liquid chamber 18 is connected to a flow passage, and the flow passage is connected to the ejection opening on one hand, and is connected to the common liquid chamber 18 on the other hand.

The common liquid chamber 18 is provided with a filter in a projecting shape (columnar shape) for preventing dusts from entering in an inlet (connecting portion between the common liquid chamber and the flow passage) of the flow passage communicated with the foaming chamber 17. In the present embodiment, as illustrated in FIG. 1, the one ejecting element substrate 4 is mounted on the support member 9, and it appears that six ejection opening arrays are present in the ejecting element substrate 4, but as apparent from the enlarged part illustrated in FIG. 2B, since two common ejection opening arrays are present on both sides of the one supply port 7, the ejection opening arrays on both sides of the supply port 7 are assumed as one array, and therefore three ejection opening arrays (A array, B array and C array) are assumed to be present on this print element.

Figure 3A:
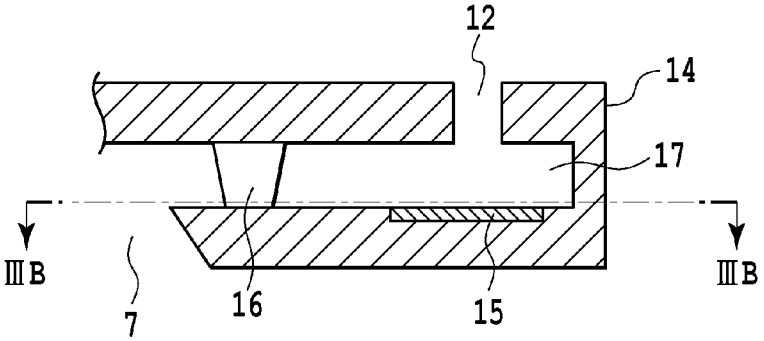
FIG. 3A is a cross section taken along line IIIA-IIIA in FIG. 2A.
Figure 3B:
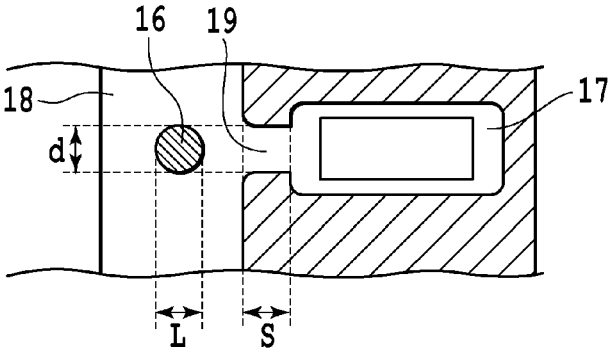
FIG. 3B is a cross section taken along line IIIB-IIIB in FIG. 3A, as viewed from the upper side.
Figure 3C:
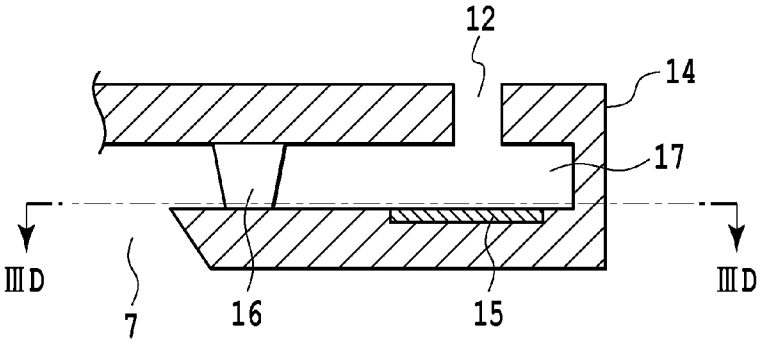
FIG. 3C is a cross section taken along line IIIC-IIIC in FIG. 2A.
Figure 3D:
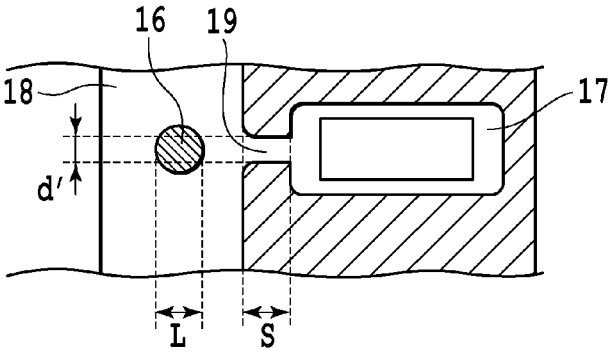
FIG. 3D is a cross section taken along line IIID-IIID in FIG. 3C, as viewed from the upper side.

FIG. 3A is across section taken along line IIIA-IIIA in FIG. 2A, and FIG. 3B is a cross section taken along line IIIB-IIIB in FIG. 3A, as viewed from the upper side. FIG. 3C is a cross section taken along line IIIC-IIIC in FIG. 2A, and FIG. 3D is a cross section taken along line IIID-IIID in FIG. 3C, as viewed from the upper side. In the present embodiment, a width of a flow passage 19 communicating the common liquid chamber 18 in which the filter 16 is disposed with the foaming chamber 17 is defined as d, d', a length thereof is defined as s, and a diameter of the filter 16 is defined as L.

As described above, in the ejecting element substrate during printing, heat is generated accompanying the printing. The generated heat is transmitted to the periphery of the ejecting element substrate and is released through the ejecting element substrate and the support member. However, the amount of heat release per unit time is limited, and therefore when the amount of heat generation per unit time is large as at the high-speed printing, the heat release cannot be sufficiently performed, thus increasing the temperature of the ejecting element substrate partially (in the central part). Particularly among the ejection opening arrays on the ejecting element substrate, the heat generated in the ejection opening array close to the center of the ejecting element substrate is difficult to be released, therefore increasing the temperature in the central part of the ejecting element substrate to be high. When the temperature in the central part of the ejecting element substrate becomes high in this way, the ink viscosity is reduced to increase a refill speed of ink. Therefore the ink overflows from the ejection opening and stays in the periphery of the ejection opening surface, thereby generating an ejection defect and degrading the print quality. As a result, the measure for preventing the print quality from degrading is required.

Therefore in the present embodiment, among the three ejection opening arrays (arrangement area) in the ejecting element substrate 4, a flow resistance of the flow passage 19 corresponding to the B array positioned in the middle (in a direction crossing a predetermined direction where the ejection openings are arrayed) is made larger than a flow resistance of the flow passage 19 corresponding to each of the other ejection opening arrays (A array, C array). In the ejection opening array of each of the A array and the C array, the width of the flow passage 19, as illustrated in FIG. 3B, is defined as width d as a wide width, and in the ejection opening array of the B array, the width of the flow passage 19, as illustrated in FIG. 3D, is defined as width d' as a narrow width (d>d').

In this way, in the ejection opening array of the B array, the flow resistance in the flow passage 19 is made large by narrowing the width of the flow passage 19. By thus increasing the flow resistance in the flow passage 19 to be large, even when the temperature in the ejection opening array of the B array becomes high to reduce the ink viscosity, the refill speed of the ink does not increase because of the high flow resistance, resulting in no overflow of the ink from the ejection opening. Therefore the generation of the ejection defect can be suppressed to suppress the degradation in print quality. It should be noted that the structure in which the flow resistance of the flow passage 19 in the ejection opening array of the B array is made large is designed in such a manner that the refill speed can be maintained as a sufficient speed even at a low temperature. In regard to specific dimensions of the flow passages, a flow passage width of the flow passage corresponding to the ejection opening array of each of the A array and C array is defined as 14μ and a flow passage width of the flow passage corresponding to the ejection opening array of the B is defined as 10μ.

Figure 4A:
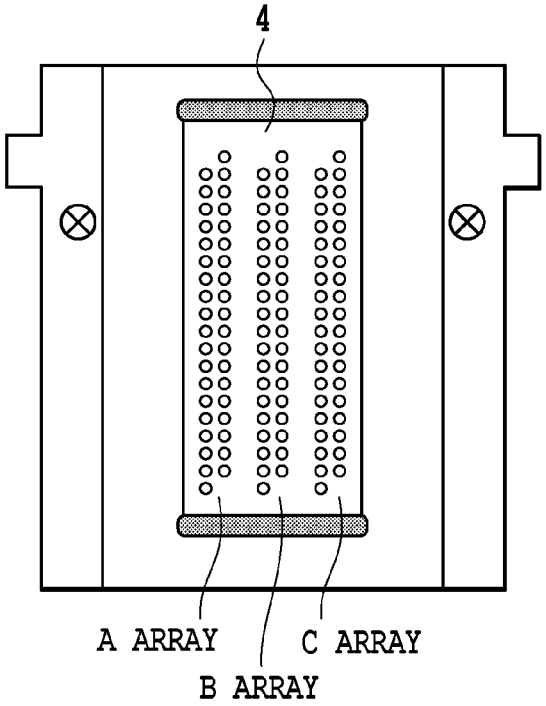
FIG. 4A is a drawing illustrating an ejecting element substrate and flow passages in a liquid ejecting head according to a modification of the first embodiment.
Figure 4B:
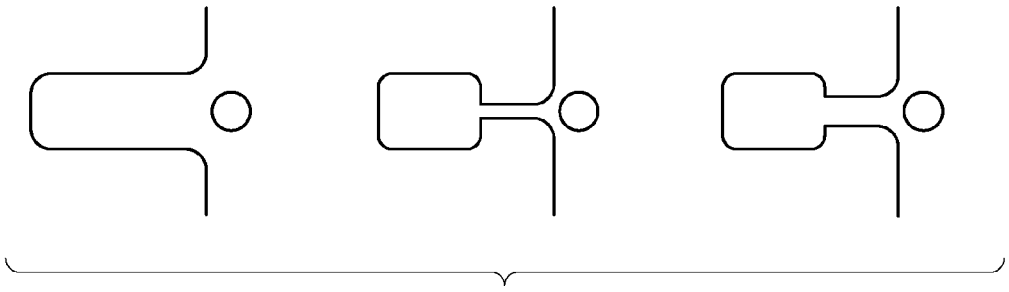
FIG. 4B comprises diagrams illustrating the flow passages having different widths.

In addition, here, the explanation is made on a condition that the ejection opening arrays of the A array and the C array have the same structure, but the flow resistance of the flow passage corresponding to the ejection opening of the flow passage of the central ejection opening array (B array) is only required to be the largest, and the other ejection opening arrays do not each have necessarily the same structure. For example, as illustrated in FIG. 4A, among the three ejection opening arrays, as illustrated in FIG. 4B the width of the flow passage corresponding to the central ejection opening array is the narrowest, and three kinds of the flow passage may have different widths from each other.

In this way, in the ejecting element substrate arranged the closest to the center of the support member, the flow resistance of the flow passage corresponding to the ejection opening of the ejection opening array arranged the closest to the center of the ejecting element substrate is made high. This allows realization of the liquid ejecting head, the ejecting element substrate, and the liquid ejecting apparatus that can suppress the degradation in print quality.

Second Embodiment

Hereinafter, an explanation will be made of a second embodiment of the present invention with reference to the accompanying drawings. Since a basic structure of the present embodiment is the same as that of the first embodiment, hereinafter only a characteristic structure thereof will be explained.

Figure 5:
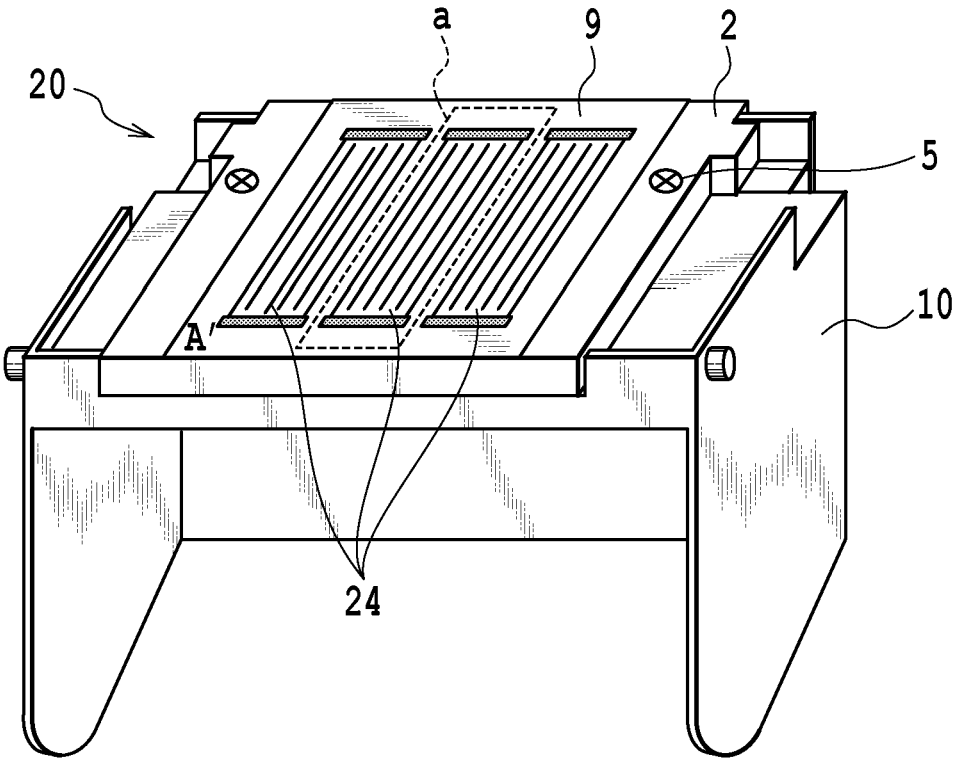
FIG. 5 is a perspective view illustrating a liquid ejecting head according to a second embodiment of the present invention.

FIG. 5 is a perspective view illustrating a liquid ejecting head 20 to which the present invention is applicable. The liquid ejecting head 20 in the present embodiment is provided with three ejecting element substrates 24 mounted on the support 9. Four ejection opening arrays are mounted on each of the three ejecting element substrates 24.

Figure 6A:
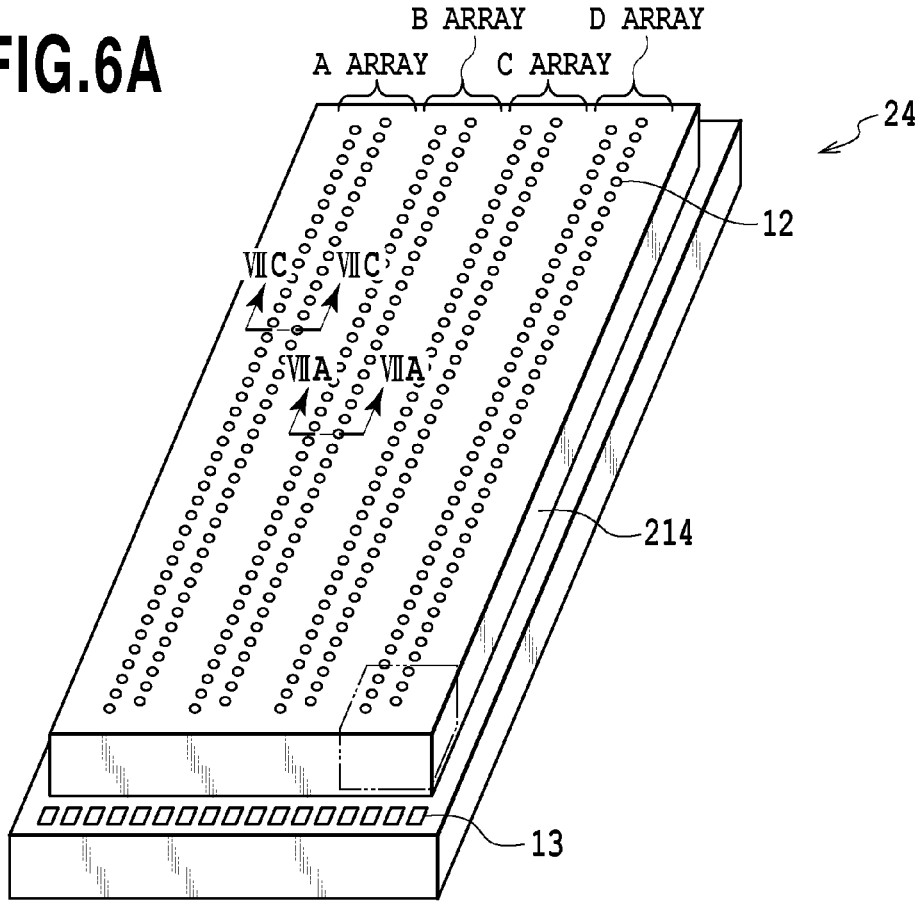
FIG. 6A is a perspective view illustrating an ejecting element substrate according to the second embodiment.
Figure 6B:
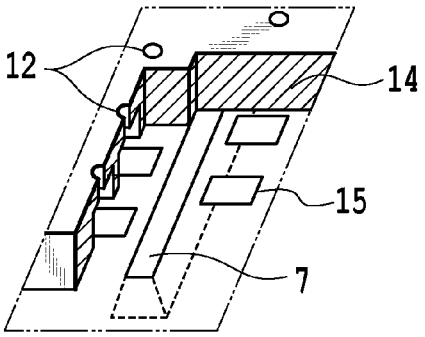
FIG. 6B is a diagram illustrating a part of the ejecting element substrate in an enlarging manner according to the second embodiment.

FIG. 6A is a perspective view illustrating the ejecting element substrate 24 in the present embodiment, and FIG. 6B is a diagram illustrating a part of the ejecting element substrate 24 in an enlarged manner. The respective ejection opening arrays of the ejecting element substrate 24 are indicated in the order of A array, B array, C array and D array from the left side.

Figure 7A:
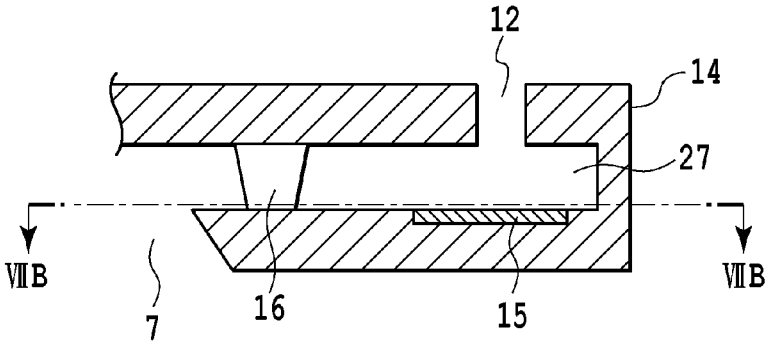
FIG. 7A is a cross section taken along line VIIA-VIIA in FIG. 6A.
Figure 7B:
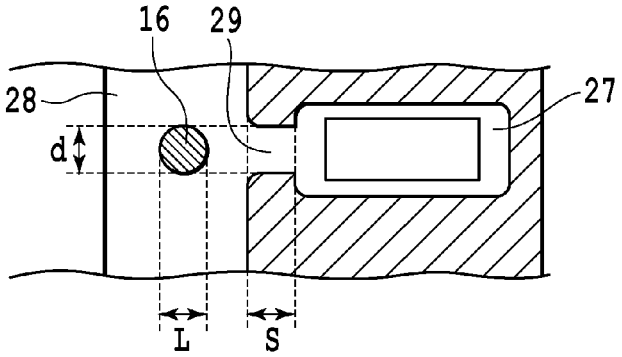
FIG. 7B is a cross section taken along line VIIB-VIIB in FIG. 7A, as viewed from the upper side.
Figure 7C:
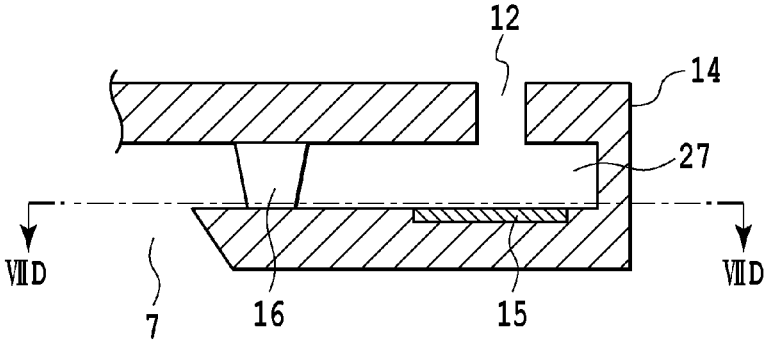
FIG. 7C is a cross section taken along line VIIC-VIIC in FIG. 6A.
Figure 7D:
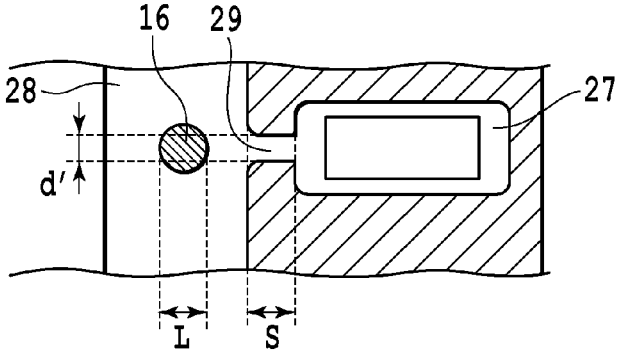
FIG. 7D is a cross section taken along line VIID-VIID in FIG. 7C, as viewed from the upper side.

FIG. 7A is across section taken along line VIIA-VIIA in FIG. 6A, and FIG. 7B is a cross section taken along line VIIB-VIIB in FIG. 7A, as viewed from the upper side. FIG. 7C is a cross section taken along line VIIC-VIIC in FIG. 6A, and FIG. 7D is a cross section taken along line VIID-VIID in FIG. 7C, as viewed from the upper side. In the present embodiment, a width of a flow passage 29 communicating a common liquid chamber 28 with a foaming chamber 27 is defined as d, d', a length thereof is defined as s, and a diameter of a filter is defined as L.

In FIG. 5, among the four ejection opening arrays of the central ejecting element substrate 24 in the three arranged ejecting element substrates 24, a flow resistance of the flow passage 29 corresponding to the ejection opening array of each of the B array and the C array positioned in the middle is made larger than a flow resistance of the flow passage 29 corresponding to each of the other ejection opening arrays (A array, D array). In each of the A array and the D array, the width of the flow passage 29, as illustrated in FIG. 7B, is defined as width d as a wide width, and in each of the B array and C array, the width of the flow passage 29, as illustrated in FIG. 7D, is defined as width d' as a narrow width (d>d').

In this way, in the ejection opening array of each of the B array and C array, a cross-sectional area of the flow passage 29 is made small by narrowing the width of the flow passage 29 to increase the flow resistance in the flow passage 29. When the flow passage resistance in the flow passage 29 is thus made large, even if the temperature in each of the B array and C array becomes high to reduce the ink viscosity, the refill speed of the ink does not increase. Therefore it is possible to suppress the generation of the ejection defect and degradation in print quality.

It should be noted that among the three arranged ejecting element substrates 24, all the ejection opening arrays of the ejecting element substrates 24 positioned other than the center thereof (in both ends of the left and right) have the same configuration (the flow resistance in the flow passage is not made high).

In addition, in the present embodiment, it is explained that the A array and D array, and the B array and C array respectively have the same structure, but the flow resistance of the flow passage of the array arranged the closest to the center thereof (B array or C array or both thereof) is only required to be the largest, and a shape of the flow passage in the other array is not particularly limited. However, it is preferable that a width of the flow passage 29 of only each of the B array and C array in the central ejecting element substrate of the support member is narrow, and the arrays of the other ejecting element substrates have the same structure. The reason is that as long as the arrays have the same design, there is a degree of freedom for color changing and only two kinds of the ejecting element substrates are required, and it is relatively less expensive to manufacture. In addition, when the ejecting element substrates are formed in symmetry to each other, it has an advantage in a case of equally arranging a few colors in a plurality of arrays.

Figure 8A:
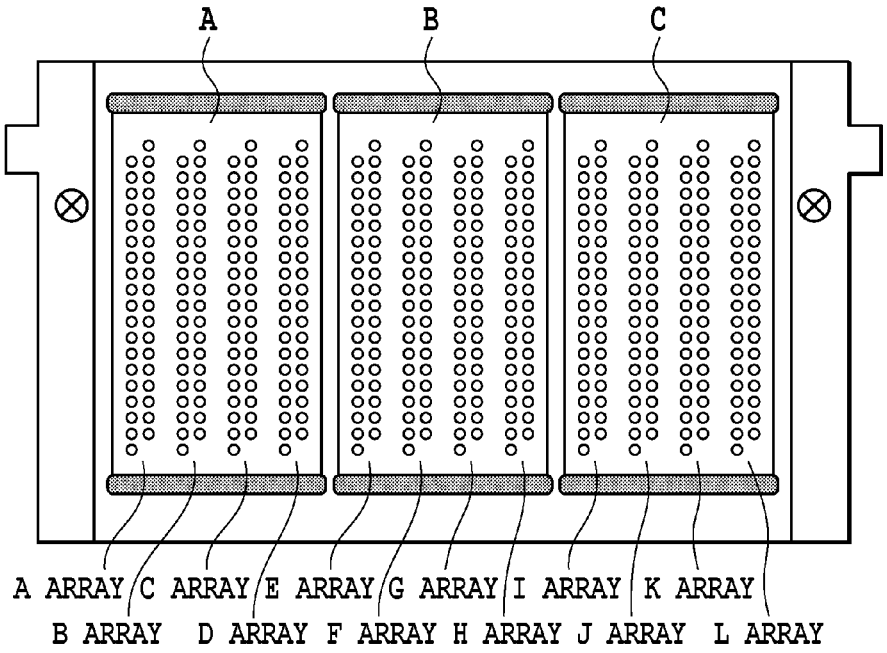
FIG. 8A is a diagram illustrating symmetry of the ejecting element substrates in the liquid ejecting head according to the second embodiment.
Figure 8B:
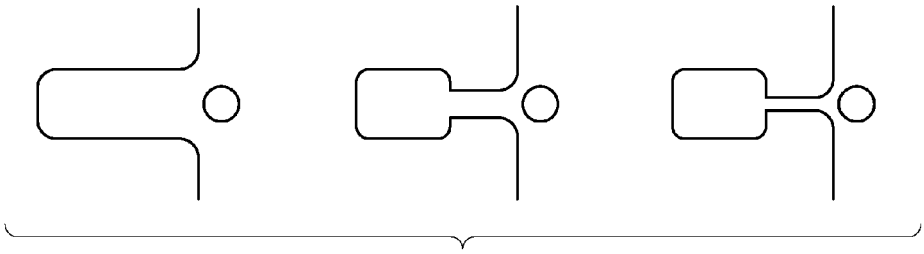
FIG. 8B is a diagram illustrating flow passages having different widths according to the second embodiment.

FIG. 8A is a diagram explaining symmetry of the ejecting element substrates in the liquid ejecting head, and FIG. 8B comprises diagrams illustrating different flow passages. For example, in a case of using eight colors of cyan C, magenta M, yellow Y, photo cyan PC, photo magenta PM, photo black PB, matte black MBK and gray Gy, a liquid ejecting head is considered to be structured with the following ejecting element substrates A and C in FIG. 8A. A flow resistance of the flow passage in the central array is made the largest. The ejecting element substrates A and C in FIG. 8A each have two different kinds of the flow passages that are designed to be optimal for some color in the other arrays.

Since the ejecting element substrates A and C having the different flow passages in the ejection opening arrays in both ends in the left and right are in common, the symmetry of the liquid ejecting head is broken as a whole. Further, depending on the ink, an ink color usable in an A array of the ejecting element substrate A has to be arranged in an I array of the ejecting element substrate C, and therefore not only a degree of freedom is lowered, but also in some cases there is no ink color usable. In this case, another kind of ejecting element substrate is required to be prepared, leading to an increase in cost.

However, when the ejecting element substrates A to C are all structured to maintain the common structure or the symmetry, standard deep colors of C, M and Y are arranged in symmetry in a way that inks corresponding to A array to I array correspond to C, M, PC, PBK, MBK, MBK, Gy, PM, Y, M, C. In a case of this symmetry arrangement, the liquid ejecting head can move bi-directionally for printing to realize the high speed.

In this way, in the ejecting element substrate arranged the closest to the center of the support member, the flow resistance of the flow passage corresponding to the ejection opening of the ejection opening array arranged the closest to the center of the ejecting element substrate is made high. This allows realization of the liquid ejecting head, the ejecting element substrate, and the liquid ejecting apparatus that can suppress the degradation in print quality.

Third Embodiment

Hereinafter, an explanation will be made of a third embodiment of the present invention with reference to the accompanying drawings. Since a basic structure of the present embodiment is the same as that of the first embodiment, hereinafter only a characteristic structure thereof will be explained.

Figure 9A:
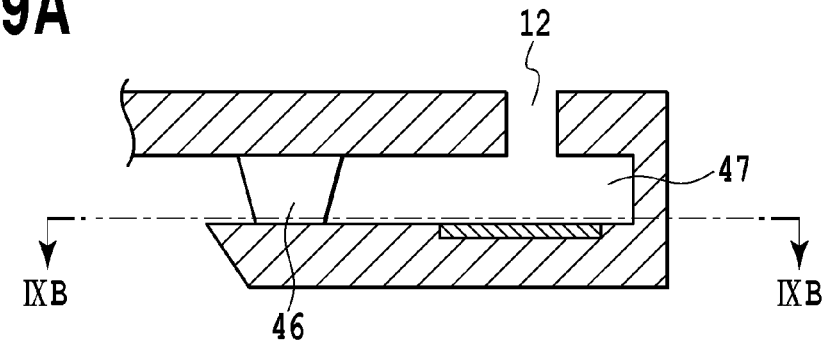
FIG. 9A is a cross section illustrating an ejection opening part in a liquid ejecting head according to a third embodiment of the present invention.
Figure 9B:
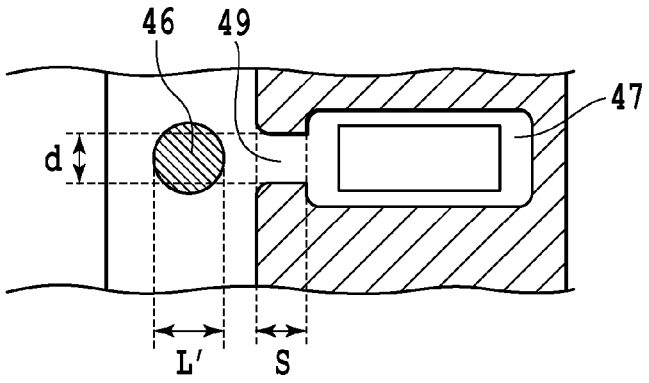
FIG. 9B is a cross section taken along line IXB-IXB in FIG. 9A, as viewed from the upper side.

FIG. 9A is a cross section illustrating an ejection opening part of a liquid ejecting head in the present embodiment, and FIG. 9B is a cross section taken along line IXB-IXB in FIG. 9A, as viewed from the upper side. As compared to FIG. 7B in the second embodiment, the present embodiment is configured such that a diameter of a filter 46 corresponding to the ejection opening array arranged the closest to the center of the ejecting element substrate is made large (changes) to narrow an inlet of a flow passage 49 communicated with a foaming chamber 47. The flow resistance is made high by narrowing the inlet of the flow passage 49 communicated with the foaming chamber 47. The other ejection opening arrays other than the closest ejection opening array to the center have the same structure as the ejection opening part illustrated in FIG. 7B, and the flow passage is designed such that a diameter of the filter is smaller than that of the filter 46 in the center.

It should be noted that in the present embodiment, the inlet of the flow passage communicated with the foaming chamber is narrowed by increasing the diameter of the filter to increase the flow resistance to be high, but the filter itself may be disposed closer to the inlet of the flow passage without changing the diameter of the filter to narrow the inlet of the flow passage communicated with the foaming chamber and increase the flow resistance to be high.

In this way, in the ejecting element substrate arranged the closest to the center of the support member, the flow resistance of the flow passage corresponding to the ejection opening of the ejection opening array arranged the closest to the center of the ejecting element substrate is made high. This allows realization of the liquid ejecting head, the ejecting element substrate, and the liquid ejecting apparatus that can suppress the degradation in print quality.

Fourth Embodiment

Hereinafter, an explanation will be made of a fourth embodiment of the present invention with reference to the accompanying drawings. Since a basic structure of the present embodiment is the same as that of the first embodiment, hereinafter only a characteristic structure thereof will be explained.

Figure 10A:
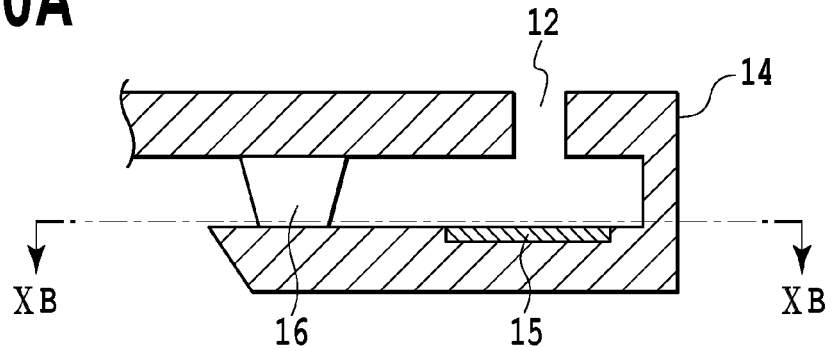
FIG. 10A is a cross section illustrating an ejection opening part in a liquid ejecting head according to a fourth embodiment of the present invention
Figure 10B:
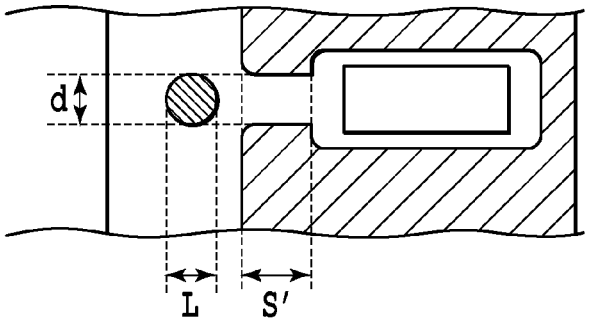
FIG. 10B is a cross section taken along line XB-XB in FIG. 10A, as viewed from the upper side.

FIG. 10A is a cross section illustrating an ejection opening part of a liquid ejecting head in the present embodiment, and FIG. 10B is a cross section taken along line XB-XB in FIG. 10A, as viewed from the upper side. In each of the aforementioned embodiments, the means for changing the flow resistance of the flow passage communicated with the foaming chamber is explained by changing the width of the flow passage continuous to the foaming chamber or the diameter of the filter, but in the present embodiment, a length of the flow passage is changed to change the flow resistance of the flow passage.

As in FIG. 10B, a length of the flow passage is defined as s' in the present embodiment, and as compared to FIG. 7B in the second embodiment, the present embodiment has the same filter diameter, the same width of the flow passage as those in the second embodiment, and has the length s' longer than the length s. Thereby the flow resistance of the flow passage corresponding to the ejection opening array arranged the closest to the center of the ejecting element substrate is made large.

It should be noted that although not illustrated herein, the flow resistance may be made large by extending not only the elongated part of the flow passage but also an entire length of the flow passage including from the ink supply passage to the foaming chamber.

In this way, in the ejecting element substrate arranged the closest to the center of the support member, the flow resistance of the flow passage corresponding to the ejection opening of the ejection opening array arranged the closest to the center of the ejecting element substrate is made high. This allows realization of the liquid ejecting head, the ejecting element substrate, and the liquid ejecting apparatus that can suppress the degradation in print quality.

Fifth Embodiment

Hereinafter, an explanation will be made of a fifth embodiment of the present invention with reference to the accompanying drawings. Since a basic structure of the present embodiment is the same as that of the first embodiment, hereinafter only a characteristic structure thereof will be explained.

In each of the aforementioned embodiments, only one factor out of the width of the flow passage communicated with the foaming chamber, the diameter of the filter and the length of the flow passage is changed to differentiate the flow resistance of the flow passage, but the flow resistance of a total of the flow passages leading to the foaming chamber is only required to be large. That is, the present invention may have a combination of the flow passage width, the flow passage length and the filter diameter all of which are different. It should be noted that since various variations may be conceived and are not limited to a particular one, the drawing is omitted herein.

In this way, in the ejecting element substrate arranged the closest to the center of the support member, the flow resistance of the flow passage corresponding to the ejection opening of the ejection opening array arranged the closest to the center of the ejecting element substrate is made high. This allows realization of the liquid ejecting head, the ejecting element substrate, and the liquid ejecting apparatus that can suppress the degradation in print quality.

Sixth Embodiment

Hereinafter, an explanation will be made of a sixth embodiment of the present invention with reference to the accompanying drawings. Since a basic structure of the present embodiment is the same as that of the first embodiment, hereinafter only a characteristic structure thereof will be explained.

Figure 11:
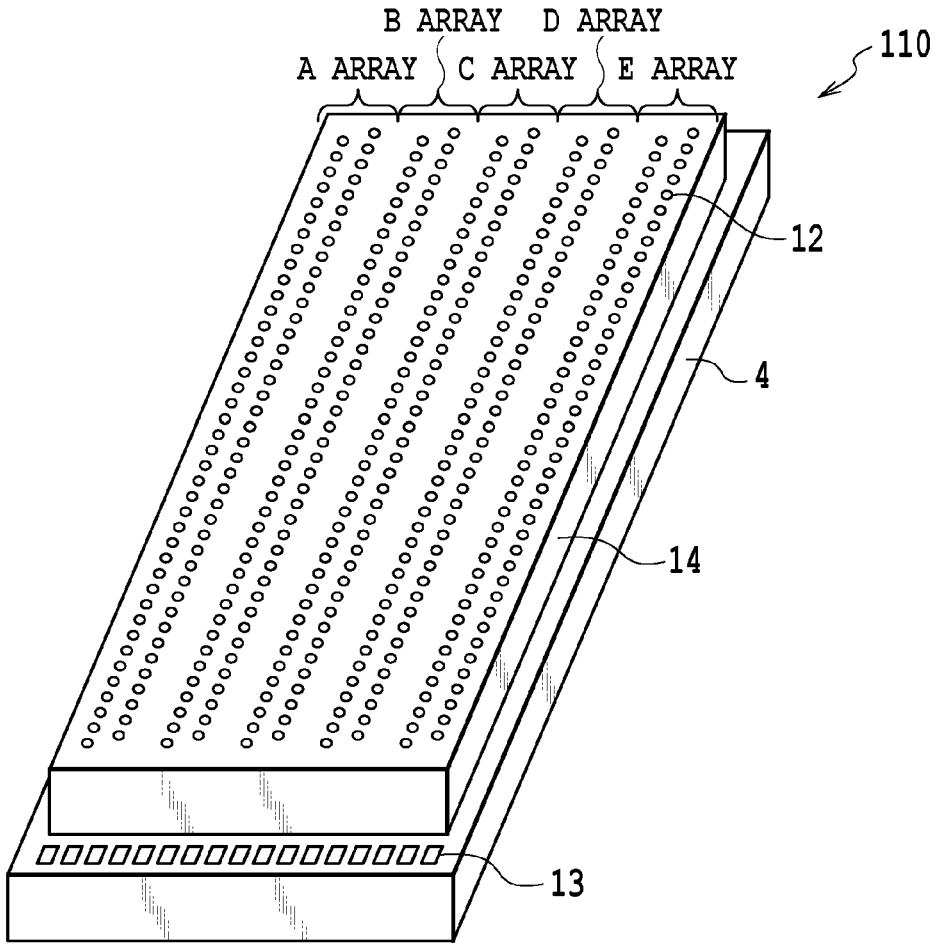
FIG. 11 is a schematic diagram illustrating an ejecting element substrate arranged in the center of a support member according to a sixth embodiment of the present invention.

FIG. 11 is a schematic diagram illustrating an ejecting element substrate 110 arranged in the center of the support member in the present embodiment. In the present embodiment, odd numbers of ejection opening arrays are disposed in the ejecting element substrate 110, and comprise five ejection opening arrays (A array, B array, C array, D array and E array). The central array on the ejecting element substrate is C array, and a flow resistance of a flow passage corresponding to the ejection opening array of C array is made the largest.

In this way, in the ejecting element substrate arranged the closest to the center of the support member, the flow resistance of the flow passage corresponding to the ejection opening of the ejection opening array arranged the closest to the center of the ejecting element substrate is made high. This allows realization of the liquid ejecting head, the ejecting element substrate, and the liquid ejecting apparatus that can suppress the degradation in print quality.

Seventh Embodiment

Hereinafter, an explanation will be made of a seventh embodiment of the present invention with reference to the accompanying drawings. Since a basic structure of the present embodiment is the same as that of the first embodiment, hereinafter only a characteristic structure thereof will be explained.

Figure 12:
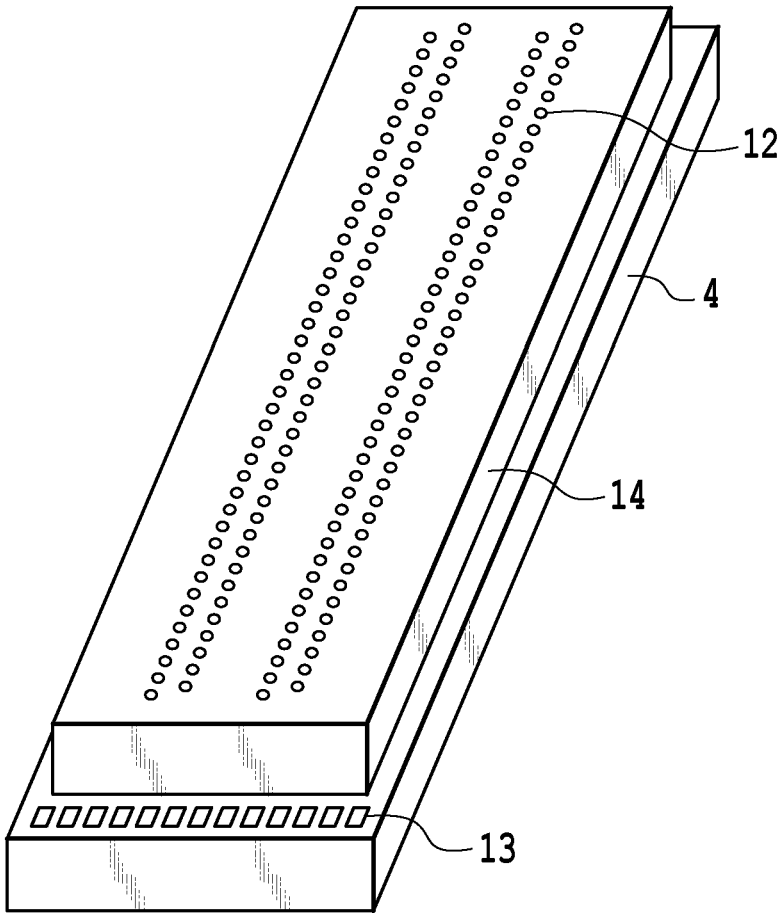
FIG. 12 is a schematic diagram illustrating an ejecting element substrate according to a seventh embodiment of the present invention.

FIG. 12 is a schematic diagram illustrating an ejecting element substrate in the seventh embodiment, and in the present embodiment, two ejection opening arrays are disposed on the ejecting element substrate. In this case, a flow resistance of a flow passage in each of the two ejection opening arrays of the ejecting element substrate arranged in the center of the support member in the liquid ejecting head is made large. In a case where a plurality of ejecting element substrates are disposed on the support member, a flow resistance of a flow passage in each of the two ejection opening arrays of the ejecting element substrate arranged the closest to the center of the support member is made large, and the other ejecting element substrates each comprise an ejecting element substrate having the same configuration without increasing the flow resistance of the flow passage.

Subsequently an explanation will be made of the most preferable arrangement of inks in this ejecting element substrate. When the refill speed is fast, non-ejection is generated due to overflow of ink at refilling. Therefore a design in which the ink having the fastest refill speed is arranged in the array of maximizing the flow resistance of the flow passage corresponding to the ejection opening array arranged in the center of the ejecting element substrate is the most preferable. By doing so, also in the print at a low temperature other than the high-speed ejection, the overflow is difficult to be generated, making occurrence of problems due thereto more difficult. Here, the fast refill speed means ink having high surface tension or ink having low viscosity.

Further, preferably ink having a slow ejection speed is arranged in the central ejection opening array having a large flow resistance of the flow passage. An example of inks may include pigment black in which the burning of carbon becomes the largest in amount on a print element. When the burning becomes large, since it is difficult for heat of the print element to be transmitted to the ink, the ejection speed is reduced. On the other hand, as an additional effect by increasing the flow resistance, there is taken an example where the resistance behind the foaming chamber becomes high, and a ratio between a resistance from the foaming chamber to the ejection opening and a resistance of the flow passage part varies to improve an ejection efficiency, so that the ejection speed is inclined to be more easily increased.

Further, even in a case of the same refill speed, it has been found out by the review that as the ejection speed is faster, the ink overflows the more remarkably to create the ejection defect. From this point as well, it is preferable that the ink having a slow ejection speed and a fast refill speed is arranged in the ejection opening array arranged in the center of the ejecting element substrate.

In addition, in regard to ink of pigment or dye used in the inkjet printer for printing photos and posters regularly, the flow resistance is a dominant factor regardless of a few differences in ink properties, and a desired effect for the solution of the problems can be obtained by application of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-104876, filed May 22, 2015, which is hereby incorporated by reference herein in its entirety.

What is claimed is:

1. A liquid ejecting head comprising:

a heat generating element array in which heat generating elements to generate heat energy that is used to eject a liquid are arranged in a predetermined direction;

a pressure chamber that includes one of the heat generating elements therein; and a flow passage of which one end communicates with the pressure chamber, and of which the other end communicates with a common liquid chamber, wherein an amount per liquid droplet ejected by the heat generating elements included in the heat generating element array is equal, and wherein a flow resistance of the flow passage which communicates with a heat generating element disposed in a central portion in the predetermined direction among the heat generating elements included in the heat generating element array is higher than a flow resistance of a flow passage which communicates with a heat generating element disposed in an end portion.

2. The liquid ejecting head according to claim 1, further comprising an element substrate on which the heat generating elements are formed, the element substrate having a plurality of the heat generating element arrays in parallel in a direction intersecting with the predetermined direction, wherein a flow resistance of flow channels included in the heat generating element array which are disposed in a central portion of the element substrate is higher than a flow resistance of flow channels included in the heat generating element array arranged on an end side of the element substrate.

* * * * *